United States Patent [19]

Morishita et al.

[11] Patent Number: 4,670,215

[45] Date of Patent: Jun. 2, 1987

[54] PROCESS FOR FORMING A WEAR-RESISTANT LAYER ON A SUBSTRATE

[76] Inventors: Tsuyoshi Morishita, No.10-17, Hataga 2-chome, Aki-ku, Hiroshima-shi, Hiroshima-ken; Sigemi Osaki, No.2304, Higashikaita, Kaita-cho; Noriyuki Sakai, No.8654-3, Kumano-cho, both of Aki-gun, Hiroshima-ken; Yukio Shimizu, No.20-28, Higashihouwa, Yayoi-cho; Toshiharu Konishi, No.58, Uehara, Ueno-cho, both of Toyohashi-shi, Aichi-ken; Takahumi Sakuramoto, No.7-41, Shimohozumi 4-chome, Ibaragi-shi, Osaka-fu, all of Japan

[21] Appl. No.: 702,604

[22] Filed: Feb. 19, 1985

[30] Foreign Application Priority Data

Feb. 24, 1984 [JP] Japan ..... 59-33751

[51] Int. Cl.[4] ..... B22F 7/00

[52] U.S. Cl. ..... 419/9; 419/5; 419/8; 419/23; 419/25; 419/30; 419/31; 419/36; 419/43; 419/44; 419/54; 419/57; 419/58; 419/60; 419/65; 419/69; 428/553; 428/560; 428/681; 428/684

[58] Field of Search ..... 419/5-9, 419/23, 47, 38, 25, 31, 36, 43, 44, 54, 57, 58, 60, 65, 69; 428/553, 560, 681, 684

[56] References Cited

U.S. PATENT DOCUMENTS

| | | | |
|---|---|---|---|
| 3,983,615 | 10/1976 | Morishita | 419/10 X |
| 4,000,980 | 1/1977 | Morishita et al. | 419/12 X |
| 4,066,451 | 1/1978 | Rudy | 419/15 X |
| 4,259,112 | 3/1981 | Dolowy et al. | 419/6 |
| 4,261,745 | 4/1981 | Watanabe et al. | 419/38 X |
| 4,338,132 | 7/1982 | Okamoto et al. | 419/5 |

FOREIGN PATENT DOCUMENTS

| | | |
|---|---|---|
| 51-83834 | 7/1976 | Japan . |
| 55-21802 | 6/1980 | Japan . |

*Primary Examiner*—Stephen J. Lechert, Jr.

[57] ABSTRACT

There is disclosed a process for forming a wear-resistant, sintered layer on a metallic substrate. The process comprises steps of adhesively attaching to a surface of metallic substrate an alloy particle sheet containing 94 to 99 weight % of ternary eutectic alloy particles and 6 to 1 weight % of acryl binder, heating in a non-oxidating atmosphere to a temperature of 150° to 380° C. and holding at the temperature for at least 5 minutes, and heating a sintering temperature of the alloy particles.

17 Claims, 2 Drawing Figures

PROCESS FOR FORMING A WEAR-RESISTANT LAYER ON A SUBSTRATE

BACKGROUND OF THE INVENTION

1. Field of the Invention

The present invention relates to a process for forming a wear-resistant, sintered layer on a metallic substrate. More specifically, the present invention pertains to a process for forming on a metallic surface a wear-resistant layer by applying a sheet of wear-resistant alloy particles to the substrate and heat the substrate to a sintering temperature.

2. Description of the Prior Art

Conventionally, it has been known to form a sintered alloy layer on a metallic substrate by applying to the substrate a sheet comprised of alloy particles and a resin binder and heating the substrate to a sintering temperature. For example, in Japanese patent application 50-9398 filed on Jan. 21, 1975 and disclosed for public inspection on July 22, 1976 under the disclosure No. 51-83834, there is disclosed a process wherein an alloy particle sheet comprised of alloy particles dispersed in a binder of thermoplastic acryl resin is attached by means of a suitable solvent such as toluene to the metallic substrate and heated in an atmosphere so that a coating of the alloy particles is formed on the substrate. It should however be noted that the process is disadvantageous in that the alloy particles cannot be satisfactorily supported on the substrate in the progress of the process in a temperature wherein the resin binder is dissipated under heat. Thus, when it is desired to form a coating on an inclined surface, a curved surface or a downwardly faced surface, the alloy particles may fall from the substrate during the process. A further problem in the process is that the alloy sheet has a tendency of shrinking in the sintering process so that there is a difficulty in dimensional control. Thus, it is required to carry out after the sintering process.

In Japanese patent publication No. 55-21802, there is taught to provide a sintered tape by mixing metallic particles such as particles of WC or TiC with a resin binder, shaping into a tape configuration and heating in a press to a sintering temperature, and thereafter attach the sintered tape by means of mechanical fasteners to a mold in which a substrate is molded. However, the process is not advantageous in that increased number of steps are required to carry out the process and that it is difficult to ensure a required adhesive power of the sintered layer to the substrate.

OBJECT OF THE INVENTION

It is therefore an object of the present invention to provide a process of forming a metallic substrate with a wear-resistant coating which is substantially free from the problem of the coating material falling off the substrate during the process.

Another object of the present invention is to provide a process of forming a metallic substrate with a securely attached wear-resistant coating.

SUMMARY OF THE INVENTION

According to the present invention, the above and other objects can be accomplished by a process in which a metallic substrate is applied at a surface with a sheet containing particles of wear-resistant eutectic alloy and heated to have the eutectic alloy particles sintered. Thus, the process in accordance with the present invention comprises steps of providing on a surface of a metallic substrate a particulate alloy sheet containing 94 to 99 weight % of eutectic alloy particles and 6 to 1 weight % of acryl binder, heating in a non-oxidating atmosphere to a temperature of 150° to 380° C. and holding at the temperature for at least 5 minutes, and heating to a sintering temperature of the alloy particles.

It has been found that a particulate eutectic alloy sheet containing 85 to 97 volume % of eutectic alloy particles and 15 to 3 volume % of acryl binder mixed with the alloy particles with addition of a solvent shows a strong adhesion to the metallic substrate even under a temperature higher than 400° C. The alloy particle sheet thus formed is satisfactory in respect of adhesive power in the case where the workpiece is not subjected to vibrations and shock loads during the heating process. However, in several processes such as continuous processes using mesh belts or pushers, or processes using vacuum furnaces, the works are unavoidably subjected to vibrations and shock loads. Even under such vibrations and shock loads, the adhesive power may be sufficient to hold the sheet on the substrate as long as the temperature is below 200° C. where the resin binder shows a high adhesive power. However, under a temperature higher than 200° C., the adhesive power of the resin is decreased so that the sheet may possibly be removed from the substrate during the process. The process of the invention can effectively solve the problem.

WEAR-RESISTANT ALLOY PARTICLES

It is required that the wear-resistant alloy particles which can be used in the process of the present invention be of such nature that it provide the substrate surface with an increased wear resistance when sintered on the substrate. For the eutectic alloy particles contained in the sheet it is preferable to use a Fe-M-C type ternary eutectic alloy, wherein M is one or more of Mo, B and P. It is preferable to contain P because it shows a strong diffusion to the substrate as C does. The eutectic alloy may additionally include Cr, V, Nb, W and Ni. More specifically, the eutectic alloy should preferably be of such a type which has 10 to 50 volume % of liquid phase in a temperature between 1000° and 1150° C., the liquid phase having a good wettability to the substrate. With the liquid phase less than 10 volume % there will be a shortage of the liquid phase so that it will become difficult to obtain an effective adhesion to the substrate. Further, it will become difficult to maintain a required configuration.

Where the eutectic alloy is of a Fe-P-C type the P content itself has an effect of lowering the melting point. Further, it is coupled with the Fe and C contents to produce phosphorous eutectic crystals which are effective to improve the wear resistance. With the P content less than 0.5 weight %, the liquid phase will be less than 10 volume % so that there will be insufficient adhesion to the substrate. With the P content greater than 2.5 weight %, a network of phosphorous eutectic crystals will be produced resulting in a remarkable decrease in tenacity. Thus, it is required that the P content be between 0.5 and 2.5 weight %.

The C content is effective to obtain a strong adhesion to the substrate. It is further coupled with the Fe and P contents to improve the strength of the substrate and to form a hard layer. The C content produces with the P content the aforementioned phosphorous eutectic crystals to thereby increase the density and produce a good adhesion to the substrate. With the C content less than 1.5 weight %, there will be produced less quantity of crystallites of low melting point so that the adhesion to the substrate will become insufficient. With the C content greater than 4.0 weight %, there will be produced an excessive amount of liquired shape so that it will become difficult to maintain the shape. Further, there will be produced a network of carbides with rough grains which will cause a decrease in tenacity.

Where the eutectic alloy is of a Fe-Mo-C type, the Mo content contributes in increasing the strength of the substrate and forming a hard phase. Further, it is coupled with the Fe and C contents to decrease the melting point. With the Mo content less than 2.5 weight %, a sufficient amount of hard phase will not be produced. Further, there will be a shortage of liquid phase. Thus, the wearresistance will be decreased and the adhesion to the substrate will be weakened. With the Mo content greater than 10.5 weight %, there will be an excessive amount of liquid phase which will make the material brittle. Thus, it is recommendable that the Mo content be between 2.5 and 10.5 weight %.

Where the eutectic alloy is of a Fe-B-C type, the B content functions to produce a hard phase and lower the melting point by being coupled with the Fe and C contents. With the B content less than 0.5 weight %, there will be an insufficient amount of ternary eutectic crystals so that the wear resistance and the anit-seizure property will be adversely affected. With the B content greater than 3.0 weight %, the material will become very brittle.

In order to improve the strength and the wear resistant property of the Fe-M-C type eutectic alloy, addition of Cr, V, W, Nb, Ta and/or Ti will be effective. These elements function to improve the strength, particularly the tenacity of the substrate. Further, they are coupled with the C content to produce a hard phase. With the content of these elements greater than 10 weight %, the effects will be saturated.

Si may additionally be used to improve fluidity of molten alloy in the sintering process and obtain a good wettable property to the substrate. With the Si content greater than 5.0 weight %, there will be an adverse effect on the hardness and the wear resistant property. Ni may be added to strengthen the substrate, however, with the Ni content greater than 5.0 weight %, there will be a decrease in the hard phase so that the seizure resistant property will be adversely affected. Mn has a similar function as Ni does so that it is preferred that it be added in an amount less than 5.0 weight %.

The particle size has a large influence on the porosity of the sintered layer. It is preferred that the particle size be finer than 150 mesh. With the particle size coarser than 150 mesh, the porosity of the sintered layer will accordingly be increased giving adverse effects on the wear resistance of the sintered layer.

ADHESIVE BINDER

The acryl binder for the alloy particle sheet may preferably be selected from polymers of acryl esters and methacryl esters, copolymers of acryl esters and methacryl esters, and copolymers of these esters and monomers having functional groups copolymerizable with these esters. The binder is mixed with the alloy particles in an amount 6 to 1 weight % for 94 to 99 weight % of the alloy particles. With the binder content less than 1 weight %, the sheet will become too brittle so that flexibility of the sheet cannot be maintained. With the binder content greater than 6 weight %, there will be an adverse effect on the porosity of the sintered layer due to the excessive quantity of the resin. Further, a satisfactory adhesion to the substrate will not be obtained.

PREPARATION OF THE ALLOY PARTICLE SHEET

The alloy particle sheet can be prepared in various ways. For example, a solvent such as acetone, toluene and methylethylketone may be mixed with the binder in an amount of 100 to 1000 part in weight for 100 part in weight of the binder and formed into a sheet configuration in a mold with an intervention of a separating paper between the mixture and the mold. Thereafter, the solvent is evaporated and the binder sheet is rolled into a thickness of 0.5 to 5.0 mm.

Alternatively, the binder may be mixed with the alloy particles without using any solvent and agitated under heat if required. Then, the mixture is formed into a sheet.

APPLICATION OF THE ALLOY PARTICLE SHEET

The alloy particle sheets can readily be adhered to the substrate surface by pressing the sheets on the substrate. If necessary, however, the acryl resin which is of the same type as the binder in the sheet may be in advance applied to the substrate and/or to the sheet so that the sheet is adhered to the substrate through the resin. The adhesive resin may be applied in the form of a tape.

SINTERING

It is required that the heating be carried out under a non-oxidating atmosphere such as the atmosphere of inactive gas, for example, nitrogen and argon, under a reductant gas, for example, hydrogen, or under vacuum.

Preferably, the rate of heating is lower than 40° C./min. With a higher heating rate, components of low boiling point in the binder are suddenly evoporated so that the particle sheets may possibly be broken, or bubbles may be produced in the interface between the substrate and the sheet possibly causing removal of the sheet.

The present invention is characterized by the fact that a preheating is carried out before the temperature is increased to the sintering temperature. The preheating may be carried out by holding the workpiece under a temperature of 150° to 380° C., preferably, 200° to 350° C. for more than 5 minutes. Through the preheating process, the acryl resin in the sheets and the acryl resin applied between the substrate and the sheet are subjected to a pyrolytic polycondensation without being completely burnt producing tar or pitch-like substances. These substances function to maintain an adequate adhesive power even under a temperature higher than 300° C. to hold the sheets in place. Therefore, it is possible to prevent the alloy particle sheet from being removed from the substrate even when the preheated workpiece is transferred during the sintering process and subjected to vibrations or shock loads during the transportation. With the preheating temperature lower than 150° C., the pyrolytic reaction will not be produced to a sufficient extent so that an adequate amount of tar or pitch-like substances will not be obtained. With the preheating temperature higher than 380° C., the resin is rapidly thermally decomposed so that an adequate quantity of tar or pitch-like substances cannot be produced. A preheating time less than 5 minutes will be insufficient to produce an adequate quantity of the aforementioned substances. The preheating time may be determined in accordance with the temperature and the type of the resin. In general, it is not necessary to hold the workpiece under the preheating temperature for more than 120 minutes.

The coating produced in accordance with the process of the present invention has a good wear-resistant property and does not cause a damage or scratch on the cooperating surface. The layers of the alloy particles can be held firmly on the substrate when the workpiece is being heated from the room temperature to the sintering temperature.

In order that the invention be understood more clearly, it will now be described with reference to Tests and Examples taking reference to the accompanying drawings.

TEST AND EXAMPLES

Test 1

Figure 1:
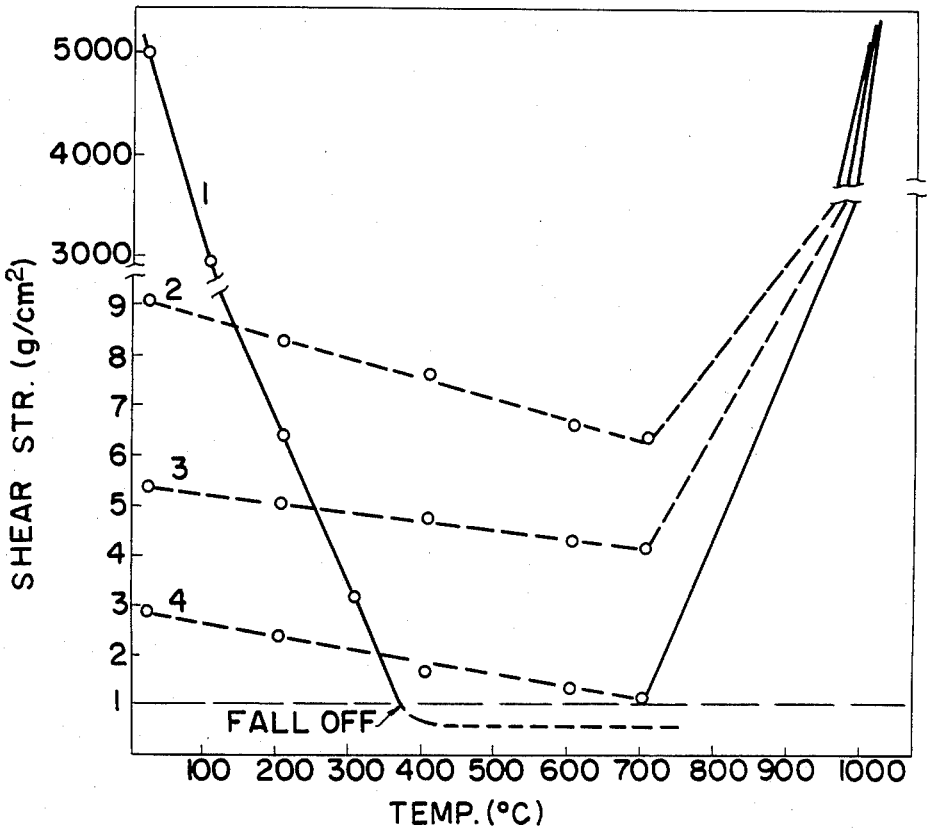
FIG. 1 is a diagram showing the relationship between the heating temperature and the shear strength; and, FIG. 2 is a diagram showing the weight decrease of acryl resin.

In order to examine the relationship between the heating condition and the adhesive power, the following test has been carried out.

A mixture of 48.5 weight % of particles finer than 150 mesh of ternary eutectic alloy containing 10.5 weight % of Mo, 2.5 weight % of Cr, 2.4 weight % of P, 3.6 weight % of C and the balance of Fe, and 48.5 weight % of particles finer than 150 mesh of a corrosion resistant steel meeting the specification of SUS 410 in Japan Industrial Standard JIS-G-4303, with 3 weight % of an acryl binder comprised of a copolymer of acryl ester and acrylic acid, is provided and kneaded with an addition of 120 part in weight of acetone for 100 part in weight of the binder. The mixture is rolled into a sheet of 2 mm thick and 4.8 g/cm$^3$ in density. The sheet is then cut into test pieces of 1 cm long and 1 cm wide. Each test piece is adhered throughout its surface to a vertical surface of a steel substrate surface with an intervention of an adhesive sheet 10 microns thick which is comprised of the same resin as in the test piece. Since the weight of the test piece is approximately 0.96 g the bonded surface is subjected to a shearing stress of 0.96 g/cm$^2$. It will therefore be understood that the test piece will not fall off if the adhesive power is greater than the shearing stress.

Four test pieces (1), (2), (3) and (4) have been prepared in accordance with the aforementioned procedure. The test piece (1) has been held as it is without applying any further treatment. The test pieces (2), (3) and (4) have been heated in an atmosphere of hydrogen gas at a heating rate of 5° C./min. respectively to 300° C., 250° C. and 380° C. and maintained at the temperatures for 60 minutes. After cooling to a room temperature, the test pieces (2), (3) and (4) as well as the test pieces (1) have been heated in a nitrogen atmosphere at a heating rate of 10° C./min. and the shear strengths have been measured at various temperatures. The results are shown in FIG. 1.

The shear strength of the test piece (1) is approximately 5000 g/cm$^2$ at the room temperature but it is decreased to approximately 3000 g/cm$^2$ at 100° C. since the binder and the adhesive tape are softened. At about 200° C., the resin starts to be dissolved and the shear strength is further decreased since a pyrolytic reaction of the resin starts at this temperature. At about 400° C., the shear strength is remarkably decreased due to an abrupt pyrolytic reaction of the resin so that the sheet falls off. At this point, the adhesive power is lower than the shear stress caused by the weight of the alloy particle sheet.

The shear strengths of the test pieces (2), (3) and (4) gradually decrease as the temperatures increase to 400° C. since there occurs a certain degree of pyrolytic reactions in the unresolved portions of the resin. Further, the shear strengths decrease between 400° and 700° C. as the temperature increases because the carbonization of the tar and the pitch-like substances progresses. However, the shear strength does not fall below approximately 1 g/cm$^2$. Above 700° C., it will be noted that the shear strengths increase because sintering processes progress. At about 1000° C., the eutectic crystals in the alloy are molten to produce liquid phases which diffuse in the substrate and solidify therein. Thus, the shear strength is remarkably increased.

Test 2

Figure 2:
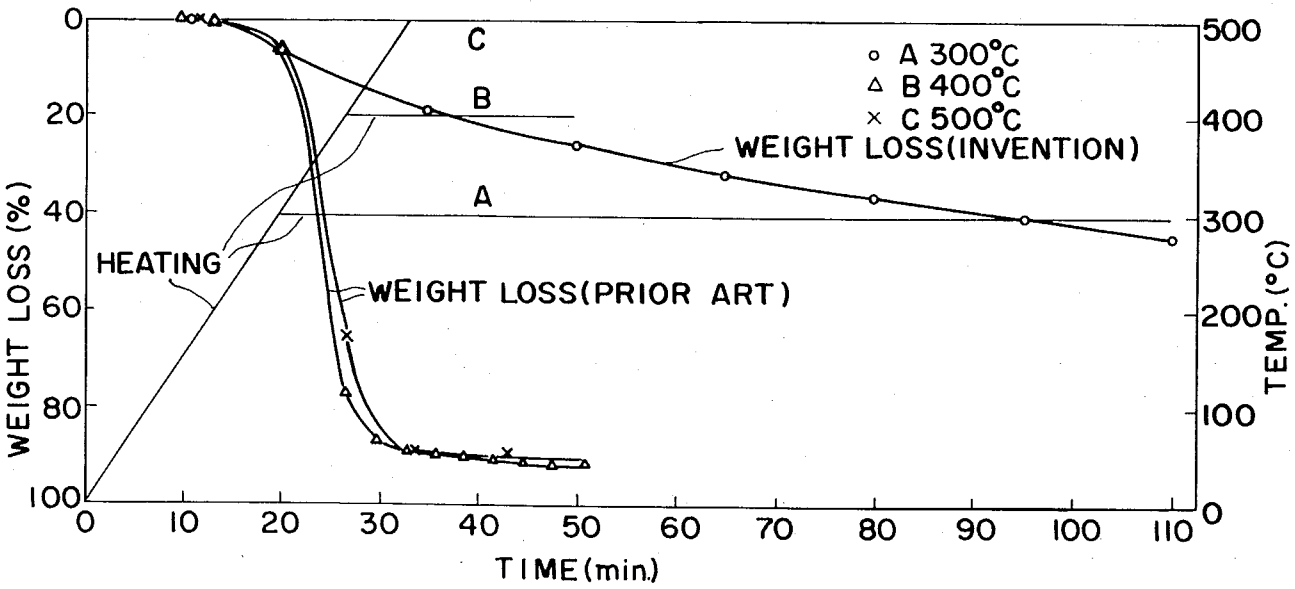

The acryl resin which has been used as the binder and as the adhesive tape has been heated is various ways in a nitrogen gas atmosphere and tested in respect of changes in weight. The results are shown in FIG. 2. In FIG. 2, the test pieces A, B and C have been heated respectively to 300° C., 400° C. and 500° C. at a heating rate of 15° C./min. and maintained at the temperature. It will be noted in FIG. 2 that the weight decrease of the acryl resin is approximately 7% at 300° C., but the weight decrease will become approximately 90% when the resin is further heated to 400° C. due to an abrupt pyrolytic reaction. It will further be noted that, in case of the test piece A which is maintained at 300° C. for 60 minutes, the weight decrease is only approximately 40%. In the test piece A, there are produced the tar and pitch-like substances due to the pyrolytic condensation reaction and it is considered that these substances function to maintain the adhesive power under 400° to 700° C. In contrast to this, in the test pieces B and C which are heated to 400° C. and 500° C., respectively, approximately 90% of resin is dissolved so that little quantity of tar and pitch-like substances are produced. Thus, the alloy particle sheet falls off in the heating process unless a preheating step is carried out.

Test 3

In order to ascertain that the tar and pitch-like substances are produced, the following tests have been carried out.

The acryl resin which has been used as the binder and the adhesive tape in the Test 1 has been heated in a nitrogen atmosphere, at a heating rate of 15° C./min. to 300° C. and maintained at the temperature for 60 minutes. Thereafter, the resin has been heated at a heating rate of 15° C./min. to 500° C. and 700° C. After cooling, the material is analyzed. The results are shown in Table 1.

TABLE 1

| Test Pieces | Final Temp. | C% | H% | H/C |
|---|---|---|---|---|
| D | 500° C. | 91.7 | 5.9 | 0.77 |
| E | 700° C. | 95.2 | 1.4 | 0.18 |

In general, the H/C ratio of a so-called pitch is greater than 1.0 in the case of asphalts and 0.5 to 0.6 in the case of coal tar pitches. In the test piece D, it will be understood that there are tar and pitch-like substances since the H/C ratio is 0.77. In the test piece E, it will be noted, from the fact that the H/C ratio is 0.18, that the tar and pitch-like substances are decreased due to carbonization.

TEST 4

Test pieces F, G and H are prepared from the acryl resin used in the Test 1. The test pieces have been heated at a heating rate of 15° C./min to 300° C. and maintained at the temperature for 60 minutes. The test piece F has been cooled. The test pieces G and H have been heated respectively to 400° C. and 600° C. After cooling, the resin has been analyzed. The results are shown in Table 2.

TABLE 2

| Test Piece | C% | H% | H/C |
|---|---|---|---|
| F | 69.2 | 9.4 | 1.63 |
| G | 75.5 | 8.0 | 1.27 |
| H | 94.1 | 2.8 | 0.36 |

EXAMPLE 1

A mixture of 48.5 weight % of particles finer than 150 mesh of ternary eutectic alloy containing 10.5 weight % of Mo, 2.5 weight % of Cr, 2.4 weight % of P, 3.6 weight % of C and the balance of Fe, and 48.5 weight % of particles finer than 150 mesh of a corrosion resistant steel meeting the specification of SUS 410 in Japan Industrial Standard JIS-G-4303, with 3 weight % of an acrylic binder comprised of a copolymer of acryl ester and acrylic acid, is provided and kneaded with an addition of 200 part in weight of acetone for 100 part in weight of the acrylic binder. The mixture is then rolled into a sheet of 2 mm thick and 4.8 g/cm$^3$ in density. The sheet is then cut into test pieces of 1 cm long and 1 cm wide. Each test piece is adhered throughout its surface to a vertical surface of a steel substrate surface with an intervention of an adhesive sheet 10 microns thick which is comprised of the same resin as in the test piece. The test pieces are then heated in a hydrogen atmosphere at a heating rate of 15° C./min. to 300° C. and maintained at the temperature for 60 minutes. Thereafter, the test pieces are heated at a heating rate of 15° C./min. to 1090° C. and maintained at the temperature for 20 minutes. After cooling, it has been confirmed that the alloy particle sheets have not fallen off the substrates. Further, it has been observed that the substrate is formed with a sintered layer of 1.60 to 1.65 mm thick, HRC 62 to 65 in hardness and 7.60 to 7.75 g/cm$^3$ in density.

EXAMPLE 2

A mixture of 58.8 weight % of the ternary eutectic alloy particles as used in the Example 1, 39.2 weight % of SUS 410 particles and 2.0 weight % of acrylic adhesive binder is added with toluene in an amount of 300 part in weight for 100 part in weight of the binder and then kneaded. The mixture is then rolled and pressformed into a sheet of 1.0 mm thick and 4.65 g/cm$^3$ in density. The sheet is then cut into test pieces of 1 cm square. The test pieces are then adhered to vertical surfaces of steel substrates through adhesive polymer sheets of 30 microns thick of the resin as used in the test pieces. The test pieces are then heated in a hydrogen atmosphere at a heating rate of 20° C./min. to 200° C. and maintained at the temperature for 80 minutes. Thereafter, the test pieces are further heated at a heating rate of 15° C./min. to 1080° C. and maintained at the temperature for 15 minutes. Then, the test pieces are gradually cooled. It has been found that the alloy particle sheets have not been falling off the substrates and that sintered layers of 0.80 to 0.82 mm thick, HRC 61 to 63 in hardness and 7.6 to 7.7 g/cm$^3$ in density have been formed on the substrate.

EXAMPLE 3

A mixture of 38.6 weight % of particles of the eutectic alloy as used in the Example 1, 57.9 weight % of particles finer than 150 mesh of SUS 410 corrosion resistant steel and 3.5 weight % of acrylic resin binder has been kneaded with an addition of toluene and rolled into a sheet of 4.80 g/cm$^3$ in density and 1.5 mm in thickness. The sheet has then been cut into test pieces, each being of 1 cm long and 1 cm wide and the test pieces have been attached to vertical surfaces of steel substrates through adhesive polymer sheets, each being of 50 microns having the composition same as that of the resin used in the alloy particle sheet. Thereafter, each test piece has been heated at a heating rate of 10° C./min. to 380° C. and maintained at the temperature for 30 minutes. Then, the test piece has been heated at a heating rate of 15° C./min. to 1100° C. and maintained at the temperature for 20 minutes. After gradual cooling, it has been observed that the alloy particle sheet has not fallen off the substrate and the substrate surfaces have been formed with a sintered layers of 1.30 to 1.35 mm thick, HRC 60 to 62 in hardness and 7.5 to 7.7 g/cm$^3$ in density.

EXAMPLE 4

A mixture of 47.5 weight % of particles of the eutectic alloy used in the Example 1, 47.5 weight % of particles finer than 150 mesh of SUS 410 corrosion resistant steel and 5 weight % of acrylic resin binder has been kneaded a room temperature and rolled into a sheet of 1.5 mm thick and 4.35 g/cm$^3$ in denisty. The sheet has then been cut into test pieces of 1 cm long and 1 cm wide. The test pieces has then been directly attached to vertical surfaces of steel substrate. The test pieces has then been heated in vacuum at a heating rate of 15° C./min. to 300° C. and maintained at the temperature for 60 minutes, and then heated at a heating rate of 10° C./min. to 1090° C. and maintained at the temperature for 20 minutes. Thereafter, the test pieces have been cooled down at a cooling rate of 3° C./min. to 900° C. and maintained at the temperature for 20 minutes and cooled by a nitrogen gas flow. It has been observed that the alloy sheets have not fallen off and the substrates have been formed with sintered layers of 1.30 to 1.35 mm thick, HRC 63 to 65 in hardness and 7.60 to 7.75 g/cm$^3$ in density.

We claim:

1. A process for forming a wear-resistant, sintered layer on a metallic substrate, the process comprising steps of providing an alloy particle sheet containing 94 to 99 weight % of eutectic alloy particles and 6 to 1 weight % of acryl binder, attaching said alloy particle sheet to a surface of the metallic substrate, heating the alloy particle sheet and the metallic substrate in a non-oxidating atmosphere to a temperature of 150° to 380° C. and holding at the temperature for at least 5 minutes, and thereafter heating said alloy particle sheet and said metallic substrate to a sintering temperature of the alloy particles.

2. A process in accordance with claim 1 in which said eutectic alloy is of an Fe-M-C type, wherein M is selected from Mo, B, and P.

3. A process in accordance with claim 2 in which said eutectic alloy is of a type having 10 to 50 volume % of a liquid phase under 1000° to 1150° C.

4. A process in accordance with claim 2, in which said eutectic alloy contains 1.5 to 4.0 weight % of C.

5. A process in accordance with claim 2 in which said eutectic alloy contains less than 10 weight % of at least one of Cr, V, W, Nb, Ta and Ti.

6. A process in accordance with claim 2 in which said eutectic alloy contains less than 5 weight % of at least one of Si, Ni, and Mn.

7. A process in accordance with claim 2 in which said eutectic alloy particles are finer than 150 mesh.

8. A process in accordance with claim 1 in which said eutectic alloy is of Fe-P-C type containing 0.5 to 2.5 weight % of P.

9. A process in accordance with claim 1 in which said eutectic alloy is of Fe-Mo-C type containing 2.5 to 10.5 weight % of Mo.

10. A process in accordance with claim 1 in which said eutectic alloy is of Fe-B-C type containing 0.5 to 3.0 weight % of B.

11. A process in accordance with claim 1 in which said acryl binder is selected from polymers of acryl esters and methacryl esters, copolymers of acryl esters and methacryl esters, and copolymers of these esters and monomers having functional groups copolymerizable with these esters.

12. A process in accordance with claim 1 in which said alloy particle sheet is provided by kneading a mixture of the eutectic alloy particles and the acryl binder with addition of a solvent, introducing the mixture into a mold to dry therein, and rolling the dried mixture into a sheet.

13. A process in accordance with claim 1 in which said alloy particle sheet is attached to the substrate through an acryl resin adhesive.

14. A process in accordance with claim 13 in which said acryl resin adhesive is applied in the form of a sheet.

15. A process in accordance with claim 1 in which said non-oxidating atmosphere is provided by one of an inactive gas, a reducing gas and a vacuum.

16. A process in accordance with claim 1 in which the alloy particle sheet provided on the substrate is maintained at 150° to 380° C. for less than 120 minutes.

17. A process in accordance with claim 1 in which the heating is carried out at a heating rate of 40° C./min.

* * * * *